United States Patent [19]

Watanabe et al.

[11] 4,120,577

[45] Oct. 17, 1978

[54] COLOR TRANSFER COPYING PROCESS AND APPARATUS USING CHARGE REMOVING ELECTRODES

[75] Inventors: Koji Watanabe, Tokyo; Mitsunori Ohta, Kunitachi; Makoto Tomono, Hino, all of Japan

[73] Assignee: Konishiroku Photo Industry Co., Ltd., Tokyo, Japan

[21] Appl. No.: 807,015

[22] Filed: Jun. 16, 1977

[30] Foreign Application Priority Data

Jun. 25, 1976 [JP] Japan ..... 51-75197

[51] Int. Cl.[2] ..... G03G 15/01

[52] U.S. Cl. ..... 355/4; 96/1.2; 96/1.4

[58] Field of Search ..... 96/1.4, 1.2; 355/4

[56] References Cited

U.S. PATENT DOCUMENTS

| | | | |
|---|---|---|---|
| 2,986,466 | 5/1961 | Kapielian | 96/1.2 |
| 3,640,707 | 2/1972 | Caldwell | 96/1.4 |

*Primary Examiner*—John D. Welsh
*Attorney, Agent, or Firm*—James E. Nilles

[57] ABSTRACT

A color transfer copying process for forming a colored image corresponding to an original by repeating prescribed times the procedures of projecting a reflected ray image from the original to be copied on a photosensitive material uniformly charged by a charging electrode through a filter to form an electrostatic latent image on the photosensitive material, converting the latent image to a toner image by using a powdery developer containing a coloring toner and transferring electrostatically the toner image onto a transfer sheet, while using selectively blue, green and red filters. Said process is characterized in that an electrode is disposed in the vicinity of a transfer passage for the transfer paper so that it acts on the transfer paper after completion of the transfer operation and said electrode is energized in regular sequence with the same frequency as that of the transfer operations or as that of the transfer operations exclusive of the final transfer operation to neutralize or diminish the retention charge of the coloring toner transferred onto the transfer paper at the transfer operation. It is made possible at the subsequent transfer operation to transfer and superpose a predetermined quantity of the coloring toner of the coloring toner image on the photosensitive material onto the transfer paper even in areas overlapped with the coloring toner image formed at the preceding transfer operation. A direct current having a polarity reverse to that of the transfer electrode for transferring the toner image to the transfer paper is applied to said charge-removing electrode.

9 Claims, 4 Drawing Figures

COLOR TRANSFER COPYING PROCESS AND APPARATUS USING CHARGE REMOVING ELECTRODES

The present invention relates to a color transfer copying process for reproducing colored images corresponding to originals according to the image transfer process by using coloring powdery developers. More particularly, the invention relates to a color transfer copying process which is improved so that overlap transfer of coloring toners can be facilitated.

As is well known in the art, a recently developed so-called color copier in which colored images are obtained by utilizing the principle of the electrophotographic copying process has attracted attention. An example of the reproduction process of this type is as follows.

The surface of a photosensitive material including zinc oxide dispersed in a resin binder, selenium or the like is subjected to corona discharge to uniformly charge the surface of the photosensitive material. Then, rays reflected from an original are projected to the charged photosensitive material through a filter, for example, a blue filter (hereinafter referred to as "B filter") and the photosensitive material is exposed to color rays having a wave length in the region of about 400 to about 500 mμ and white rays reflected in white areas of the original. by this exposure treatment, the charge on the material is extinguished or diminished in proportion to the quantity of exposure, and an electrostatic latent image through the B filter is formed on the photosensitive material. Then, the photosensitive material is contacted with a coloring material having a color complementary relation with the above color rays (yellow-colored toner powder) to convert the latent image to a colored toner image. Then, a transfer paper advanced synchronously with the photosensitive material is subjected to the action of a corona discharge electrode (transfer electrode) and the toner image formed on the photosensitive material is electrostatically transferred onto the transfer paper. The above procedures are then repeated by using a combination of a green filter (hereinafter referred to as "G filter") and a magenta toner and a combination of a red filter (hereinafter referred to as "R filter") and a cyan toner. Namely, the above procedures are conducted three times as a whole. Thus, a colored image corresponding to the original is reproduced on the transfer paper.

However, the above color reproduction process involves various problems to be solved. For example, when a magenta toner image is superposed on a yellow toner image formed on a transfer paper, there is caused an undesirable phenomenon that the prescribed amount of the magenta toner is not allowed to adhere on the transfer sheet but only a very small amount of the magenta toner is transferred. Accordingly, the resulting image seems as if color deviation were caused in the image. Further, at the step of superposing the magenta toner on the previously transferred yellow toner, there is also caused another undesirable phenomenon that the once transferred yellow toner is retransferred to the photosensitive material, namely the yellow toner is separated from the transfer paper. It will readily be understood that if such undesirable phenomenon takes place, the color of the resulting image is quite different from the color of the original.

The present invention has been achieved as a result of our research works made with a view to developing a color transfer copying process which can overcome or moderate the foregoing defects involved in the conventional process.

It is a primary object of the present invention to provide a color transfer copying process for forming a colored image corresponding to an original by repeating prescribed times the procedures of projecting a reflected ray image from the original to be copied on a photosensitive material uniformly charged by a charging electrode through a filter to form an electrostatic latent image on the photosensitive material, converting the latent image to a toner image by using a powdery developer containing a coloring toner and transferring electrostatically the toner image onto a transfer sheet, while using selectively blue, green and red filters, said process being characterized in that an electrode is disposed in the vicinity of a transfer passage for the transfer paper so that it acts on the transfer paper after completion of the transfer operation and said electrode is energized in regular sequence with the same frequency as that of the transfer operations or as that of the transfer operations exclusive of the final transfer operation to neutralize or diminish the retention charge of the coloring toner transferred onto the photosensitive paper at the transfer operation, whereby it is made possible at the subsequent transfer operation to transfer and superpose a predetermined quantity of the coloring toner of the coloring toner image on the photosensitive material onto the transfer paper even in areas overlapped with the coloring toner image formed at the preceding transfer operation.

Other objects and features of the present invention will be apparent from the following detailed description made by reference to the accompanying drawings, in which.

Figure 1:
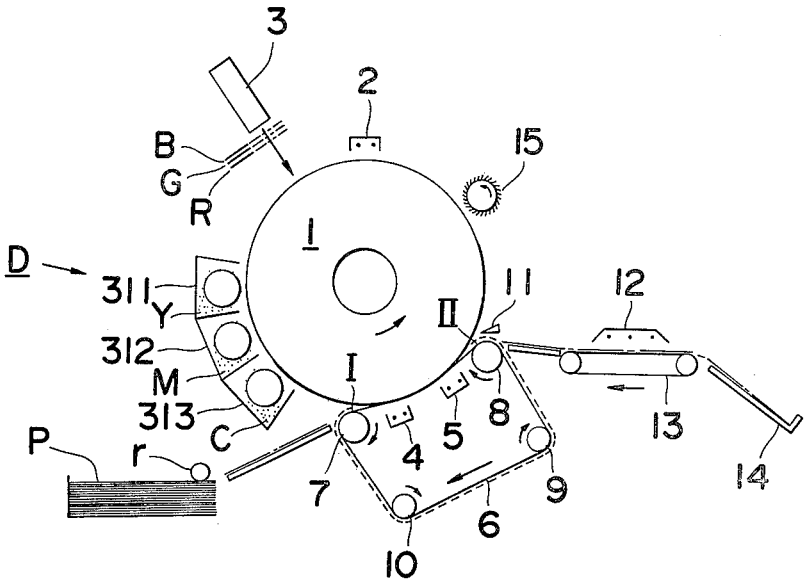
FIG. 1 is a diagram illustrating the outline of a copying apparatus having charge removing means, which is used for practising the image transfer process of the present invention.

Referring now to FIG. 1 illustrating an embodiment of the copying apparatus that is used for the practice of the color transfer copying process of the present invention, a photosensitive drum 1 (sometime referred to as "photosensitive member") comprises a drum and a zinc oxide-resin binder photosensitive paper held under stretching onto the peripheral face of the drum, and this photosensitive drum 1 is arranged so that in order to obtain one copied image, it must be sequentially rotated at least three times in a direction indicated by an arrow in the drawing. A corona discharge electrode 2 (hereinafter referred to as "charging electrode") is disposed in the vicinity of the photosensitive drum 1, and an optical system 3 including lenses is disposed to introduce rays reflected from an original exposed to rays emitted from a light source (not shown) to the photosensitive member. Blue, green and red filters B, G and R are disposed between the optical system 3 and the photosensitive drum 1 so that they can be inserted into a passage for said reflected rays according to need. A developing apparatus D consists of, for example, a magnetic brush developing apparatus, and it includes three developing devices 311, 312 and 313. Three coloring toner powders, namely, yellow, magenta and cyan toners Y, M and C, which form developers with carriers, are contained in these developing devices, respectively. A corona discharge electrode 4 (hereinafter referred to as "transfer electrode") has the same polarity as that of the charging electrode 2. Charge removing means 5 according to the present invention is disposed in the vicinity of a transfer paper passage (indicated by a chain line) so that it can act on transfer paper P which has passed through the transfer electrode 4. An alternating or direct current voltage is applied to the charge removing means 5. If a direct current voltage is applied to the charge removing device 5, it is indispensable that the polarity of the charge removing means should be reverse to the polarity of the transfer electrode 4. A transfer paper delivery belt 6 (hereinafter referred to as "delivery belt") is laid out so that it is moved in a direction indicated by an arrow around peripheries of the transfer electrode 4 and charge removing means 5. Rollers 7, 8, 9 and 10 are disposed to drive said delivery belt 6 at the same peripheral speed (linear speed) as that of the photosensitive drum 1, and one of these rollers is connected to an appropriate driving source. In the drawing, only one delivery belt 6 is shown, but practically, another delivery belt is laid out in the inner side. The delivery belt has transfer paper gripping means (hereinafter referred to as "gripping means") disposed so that the front end of the transfer paper P is gripped in the portion I and the gripping is released in the portion II after the photosensitive drum 1 has been rotated three times. Since this gripping means is not directly relevant to the characteristic feature of the present invention, the gripping means is omitted in the drawing. Further, the delivery belt 6 is arranged so that the transfer paper P is closely contacted with the image portion on the photosensitive drum 1 in a region including the transfer electrode 4. A rubber roller r feeds out the transfer paper P in response to a control signal emitted with progress of the copying operation. A separating claw 11 is disposed to separate the transfer paper P assuredly from the surface of the photosensitive drum when the front end of the transfer paper P which has separated from the delivery belt after completion of the prescribed copying operation is attracted again to the surface of the photosensitive drum. While the copying operation is being conducted, the separating claw 11 is located in a first position retreated from the photosensitive drum 1, and after completion of the copying operation, namely after the transfer operation has been conducted three times, the separating claw is inserted between the surface of the photosensitive drum 1 and the front end of the transfer paper P when the transfer paper comes close, and it is then returned to the retreated first position. When the transfer paper is sufficiently firm and it can separate smoothly from the photosensitive drum by itself, provision of the separating claw should naturally be omitted. A fixing device 12 is disposed to receive the transfer paper separated from the photosensitive drum and melt and fix the coloring toners on the transfer paper. Delivery means 13 is disposed to deliver at a predetermined speed the transfer paper introduced into the fixing device 12 and discharge the image-fixed transfer paper into a tray 14 disposed outside the copying apparatus. The delivery means 13 may be composed of, for example, a plurality of endless springs. Cleaning means 15 including a fur brush or the like is disposed to remove toners left on the photosensitive drum after completion of one cycle of the transfer operation and make preparations for the next cycle of the transfer operation.

The charge removing means according to the present invention will now be described.

Figure 2:
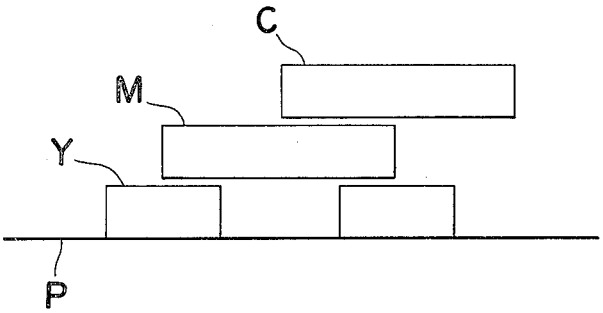
FIG. 2 is a diagram illustrating a color image in which normal color superposition is attained according to the present invention.
Figure 3:
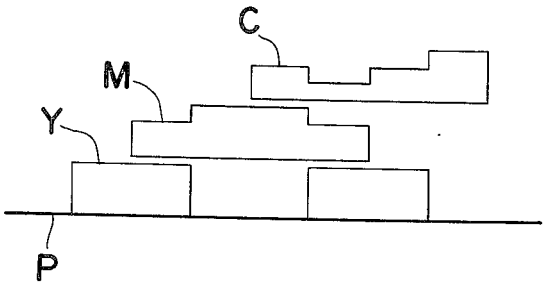
FIG. 3 is a diagram illustrating the state of color superposition attained without using charge removing means.

In the multi-color reproduction process, various colors are formed by using the above-mentioned three coloring materials. For example, a red color is formed by overlapping yellow and magenta, a green color is formed by overlapping yellow and cyan, a blue violet color is formed by overlapping cyan and magenta, and a black color is formed by overlapping the three fundamental colors. Accordingly, when an original including various colors is faithfully reproduced, all the three coloring materials are overlapped in predetermined amounts as shown in FIG. 2. When there is adopted a process in which coloring toners on the photosensitive drum 1 are transferred onto the transfer paper by an electric field formed between the transfer electrode 4 and the drum 1, the polarity of the charge of the toners possessed before the transfer is reversed by this transfer operation, and this reversion of the charge polarity is deemed to be caused by various related factors such as the charging potential, the transfer potential, the potential of the photosensitive member and the toner potential caused by friction with the carrier. Of course, the above fact has been confirmed by measuring the potential of the developed transfer paper after withdrawal of the transfer paper from the copying apparatus by means of a potentiometer while contacting a probe on the toner image. It is very difficult to clarify how the potential of the transfer paper is influenced by the transfer electrode and this has not been completely elucidated. At any rate, when a second coloring toner image is superposed on a part of a previously transferred coloring toner image at the second transfer step, there is caused an undesirable phenomenon that the toner on the transfer paper is contrarily electrostatically attracted to the drum in areas where the second coloring toner is strongly attracted to the drum surface. Further, overall superposition of the second coloring toner is not good. Namely, the amount of the second coloring toner superposed is smaller than the amount that must be superposed, and the state as shown in FIG. 3 is brought about. Accordingly, there is caused a great difference of the color or hue between the resulting image and the original.

The charge removing means 5 according to the present invention eliminates the above disadvantage. More specifically, the charge removing means neutralizes or diminishes the retention charge of the transferred image and makes it possible to allow a predetermined quantity of the subsequent coloring toner to adhere to the previously transferred toner image at the subsequent transfer step. On the other hand, it sometime happens that the polarity of the transferred toner powder is not changed and this toner repels the other coloring toner of the same polarity at the subsequent step and a state similar to that shown in FIG. 3 is brought about. This phenomenon will now be described in detail.

The apparatus, photosensitive material and transfer paper used are as follows:

Apparatus: U-Bix 600 (manufactured by Konishiroku Photo Industry Co., Ltd.)

Photosensitive member: resin binder-zinc oxide photosensitive paper (manufactured by Konishiroku Photo Industry Co., Ltd.)

Transfer paper: high quality paper having a unit weight of 55 Kg

Original: all over black

The surface potential of the photosensitive member after corona discharge is maintained at about −300 V and the development is carried out. When the surface potential of the photosensitive member is measured after the development it is +110 V in the light place. When the surface potential of the toner on the transfer paper is measured after the transfer at −5.0 KV, it is +120 V. From this experimental result, it is seen that it sometime happens that even if the transfer is conducted by corona of the negative polarity, the toner is kept positively charged. At the subsequent transfer step, the next coloring toner is not allowed to adhere sufficiently to such toner and a sufficient amount of the next coloring toner is not superposed. Also at the third transfer step, this insufficient superposition takes place. The resulting final color is not black at all but it is substantially brown. From these experimental results, it can be confirmed that the above undesirable phenomenon is due to the charge possessed by the toner after the transfer. When an original including various colors is used, the above undesirable phenomenon is conspicuous in areas where two colors are overlapped.

Charge removing means including a wire electrode is disposed in the transfer paper passage but downstream of the transfer electrode, and an alternating voltage of 5.5 KV is applied to the wire electrode. In this state, the foreging test is repeated. It is found that the toner potential is reduced to 25 V from the above value of 120 V by the action of the charge removing means. An image obtained by repeating this operation three times is found to have a color quite similar to that of the original. Further, as pointed out above, also when a direct current voltage is applied to the charge removing means, good results can similarly be obtained.

As will be apparent from the foregoing illustration, the charge removing means according to the present invention attains very prominent effects when color copies are obtained by using powdery developers according to the transfer process.

The function of the above-mentioned apparatus will now be described by reference to FIG. 4.

Figure 4:
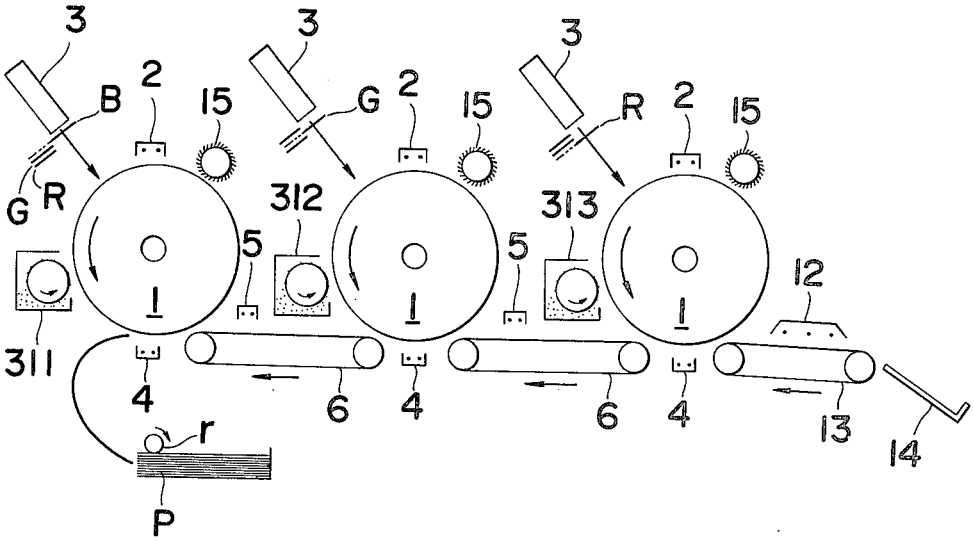
FIG. 4 is an expansion plan illustrating the steps of the color transfer copying process of the present invention.

FIG. 4 illustrates the copying apparatus using yellow, magenta and cyan toners in the state developed for the sake of better illustration. In FIG. 4, the charge removing means 5 (hereinafter referred to as "charge removing electrode") is different from the charge removing means shown in FIG. 1 in the point that it is located on a transfer paper to which the coloring toner is to adhere. A delivery belt 6 is arranged so that it confronts the charge removing electrode 5. Thus, the apparatus shown in FIG. 4 is different from that shown in FIG. 1 in some points, but there is no substantial difference between them.

The printing operation is started by appropriate start means such as a push botton. At the start of the printing operation, a charging electrode 2 begins corona discharge and with relative movement of a photosensitive drum, the surface of the drum 1 is uniformly charged. When the photosensitive drum 1 arrives at the exposure zone, rays (indicated by an arrow) reflected from the original (not shown) are projected to the photosensitive drum through an optical system 3. Since a B filter is inserted in the optical path at this point, color rays having a wave length in the region of about 400 to about 500 mμ pass through the B filter and form an electrostatic latent image on the surface of the drum 1. At the subsequent developing step, a powdery developer falls in contact with the latent image through a passage forcibly formed by the magnetic action, and a yellow toner having a wave length region of about 500 to 700 mμ converts the latent image to a visible image (hereinafter referred to as "toner image"). When the transfer paper P delivered synchronously with rotation of the photosensitive drum is closely contacted with the image area in the state gripped by gripping means (not shown) on the delivery belt 6 and passes on the transfer electrode 4, the transfer electrode 4 having the same polarity as that of the charging electrode 2 is actuated to transfer the toner image onto the transfer paper P. Immediately, the charge removing electrode 5 acts on the toner powder on the transfer paper to neutralize the charge retained by the toner or diminish it so that it has no influence at the next transfer operation. When the first transfer operation is thus completed, the toner left on the photosensitive drum 1 is wiped away by cleaning means 15, and the surface of the photosensitive drum is cleaned and stands by for the next image-forming operation. At the second operation, a G filter is used instead of the above B filter. Accordingly, color rays having a wave length in the range of about 500 to about 600 mμ form a latent image. In a developing device 312, a magenta toner having wave lengths of 400 to 500 mμ and 600 to 700 mμ is mixed with a carrier. A visible image formed by this magenta toner is transferred on the transfer paper P by the transfer electrode 4 in the same manner as described above. Since the previously transferred yellow toner has no substantial charge, a predetermined amount of the magenta toner (obtained by the development) can easily be transferred onto the yellow toner image-carrying transfer paper P even in areas where the magenta toner is superposed on the yellow toner. After completion of the second transfer operation, the transfer paper is subjected again to corona discharge by the charge removing electrode 5 to remove the retention charge from the toner powder. After the second cleaning operation, the photosensitive drum enters in the final operation. Namely, an R filter is used instead of the G filter, and the developing device 312 is replaced by a developing device 313. Rays having a wave length in the region of about 600 to about 700 mμ passes through the R filter and forms a latent image, and this latent image is visualized by a cyan toner having a wave length region of about 400 to about 600 mμ. Since the previously transferred toners have no substantial charge, the cyan toner can be sufficiently transferred even in overlapped areas. After the prescribed operations have thus been completed, the gripping action of the gripping means (not shown) on the delivery belt is released and the transfer paper is forwarded to a fixing device 12. Even if the front end of the transfer paper P is electrostatically attracted to the photosensitive drum 1, by the action of a separating claw, the front end is separated from the drum and the transfer paper can be forwarded conveniently and discharged into a tray 14. Thus, one cycle of the copying operation is completed. The toner left on the photosensitive drum 1 is wiped away by the cleaning means 15 and the photosensitive drum 1 stands by the next cycle of the copying operation.

As will be apparent from the foregoing illustration, according to the present invention, in obtaining color images by using powdery developers according to the transfer process, by a simple structure superposition and overlapping of coloring materials can be accomplished assuredly to form a color image substantially same as the original image. Thus, the present invention attains novel valuable effects.

The charge removing means that can be used in the present invention is not limited to a wire electrode as shown in the drawing. For example, roller-like and plate-like electrodes can be used. In this case, these electrodes should be arranged so that they can have sufficient contact with the back side of the transfer paper. The charge removing means need not always be actuated for all the transfer operations. More specifically, actuation of the charge removing means may be omitted at the final transfer operation. In the foregoing embodiment, the operation is repeated three times, but in the present invention, the frequency of the exposure operation (development operation) is not limited to 3. Furthermore, two filters may be inserted at every operation. Still further, the photosensitive member is not limited to a drum as illustrated in the drawing. For example, two photosensitive plates may be disposed above and below delivery means 13 having a shape as shown in FIG. 1. A known receiving type drum can conveniently be used. As regards the developer, a product comprising a coloring toner and a magnetic material can be used, and in this case, the magnetic brush method can be similarly employed. Other developing methods including the cascade developing method can be utilized in the present invention. At any rate, the technical concept of the present invention does not reside in any of individual steps or structures, but the characteristic feature of the present invention is that charge removing means is skillfully utilized in forming color image according to the above-mentioned color transfer process. Accordingly, it will be apparent that the present invention include many variations and modification within the technical scope specified in the claims.

What is claimed is:

1. A color transfer copying process for forming on a transfer sheet a colored image corresponding to an original by repeating for a prescribed number of times the procedure of: projecting a reflected ray image from the original to be copied on a photosensitive material uniformly charged by a charging electrode through a filter to form an electrostatic latent image on the photosensitive material, converting the latent image to a toner image by using a powdery developer containing a coloring toner and transferring electrostatically by means of a transfer electrode the toner image onto said transfer sheet, while using selectively blue, green and red filters, said process being characterized in that a charge-removing electrode is disposed in the vicinity of a transfer passage for said transfer sheet so that said electrode acts on said transfer sheet after completion of the transfer operation and said charge-removing electrode is energized in regular sequence with the same frequency as that of the transfer operations to diminish the retention charge of the coloring toner transferred onto the transfer sheet at the transfer operation, whereby it is possible at a subsequent transfer operation to transfer and superpose a predetermined quantity of the coloring toner of the coloring toner image on the photosensitive material onto the transfer sheet even in areas overlapped with the coloring toner image formed at the preceding transfer operation.

2. A process according to claim 1 wherein a direct current having a polarity reverse to that of said transfer electrode for transferring the toner image to the transfer sheet is applied to said charge-removing electrode.

3. A color transfer copying process for forming a colored image corresponding to an original by the procedure of:

projecting an image from the original to be copied onto a photosensitive material uniformly charged by a charging electrode through a filter to form an electrostatic latent image on the photosensitive material;

converting the latent image to a toner image by using a powdery developer containing a coloring toner;

transferring electrostatically the toner image onto a transfer sheet;

electrostatically acting on the transfer sheet after completion of the electrostatic transfer operation to diminish the retention charge of the coloring toner transferred onto the transfer sheet at the electrostatic transfer operation, whereby it is possible at a subsequent transfer operation to transfer and superpose a predetermined quantity of the coloring toner of another coloring toner image on the photosensitive material onto the transfer sheet in an area overlapped with the coloring toner image formed at the preceding transfer operation.

4. A procedure according to claim 3 wherein said transfer sheet is electrostatically acted upon in regular sequence with the same frequency as that of the transferring step.

5. A color transfer copying process for forming a colored image corresponding to an original including the steps of:

projecting an image from an original to be copied onto a photosensitve material uniformly charged by a charging electrode through a first filter to form an electrostatic first latent image on the photosentive material;

converting said first latent image to a first toner image by using a powdery developer containing a first coloring toner;

transferring electrostatically said first toner image onto a transfer sheet;

electrostatically acting on said transfer sheet after completion of the electrostatic transfer of said first toner image to diminish the retention charge of the first coloring toner transferred onto the transfer sheet;

projecting an image from the original to be copied onto a photosensitive material uniformly charged by a charging electrode through a second filter to form an electrostatic second latent image on the photosensitive material;

converting the second latent image to a second toner image by using a powdery developer containing a second coloring toner;

transferring electrostatically said second toner image onto said transfer sheet so as to transfer and superpose a predetermined quantity of the second coloring toner of the second coloring toner image on the photosensitive material onto said transfer sheet in an area overlapped with said first coloring toner image.

6. A color transfer copying apparatus for forming a colored image corresponding to an original comprising:

means for projecting an image from the original to be copied onto a photosensitive material uniformly charged by a charging electrode through a filter to form an electrostatic latent image on the photosensitive material;

means for converting the latent image to a toner image by using a powdery developer containing a coloring toner;

first electrostatic means for transferring electrostatically the toner image onto a transfer sheet;

and second electrostatic means disposed in the vicinity of a transfer passage for the transfer sheet for acting on the transfer sheet after completion of the transfer operation to diminish the retention charge of the coloring toner transferred onto the transfer sheet at the electrostatic transfer operation, whereby it is possible at a subsequent transfer operation to transfer and superpose a predetermined quantity of the coloring toner of another coloring toner image on the photosensitive material onto the transfer paper in an area overlapped with the coloring toner image formed by said first electrostatic means.

7. Apparatus according to claim 6 wherein said second electrostatic means is energized in regular sequence withh the same frequency as said first electrostatic means.

8. A color transfer copying apparatus for forming a colored image corresponding to an original comprising:

means for projecting an image from an original to be copied onto a photosensitive material uniformly charged by a charging electrode through a first filter to form an electrostatic first latent image on the photosensitive material;

means for converting said first latent image to a first toner image by using a powdery developer containing a first coloring toner;

means for transferring electrostatically said first toner image onto a transfer sheet;

means for electrostatically acting on said transfer sheet after completion of the electrostatic transfer of said first toner image to diminish the retention charge of the first coloring toner transferred onto the transfer sheet;

means for projecting an image from the original to be copied onto a photosensitive material uniformly charged by a charging electrode through a second filter to form an electrostatic second latent image on the photosensitive material;

means for converting the second latent image to a second toner image by using a powdery developer containing a second coloring toner;

and means for transferring electrostatically said second toner image onto said transfer sheet so as to transfer and superpose a predetermined quantity of the second coloring toner of the second coloring toner image on the photosensitive material onto said transfer sheet in an area overlapped with said first coloring toner image.

9. Apparatus according to claim 8 wherein said means for electrostatically acting on said transfer sheet after completion of the electrostatic transfer of said first toner image includes means for providing direct current having a polarity reverse to that of said transfer electrode for transferring the toner image to the transfer sheet which is applied to said charge-removing electrode.

* * * * *